US006045341A

United States Patent [19]

Mak

[11] Patent Number: 6,045,341

[45] Date of Patent: Apr. 4, 2000

[54] LEVITATION BLOWER

[75] Inventor: Kai-Shun Mak, Kwai Chung, The Hong Kong Special Administrative Region of the People's Republic of China

[73] Assignee: Hop Lee Cheong Industrial Company Limited, The Hong Kong Special Administrative Region of the People's Republic of China

[21] Appl. No.: 09/115,389

[22] Filed: Jul. 14, 1998

[51] Int. Cl.[7] ..... F04B 17/03; A63B 57/00

[52] U.S. Cl. ..... 417/411; 446/179

[58] Field of Search ..... 417/411, 423.14, 417/234; 446/178, 179, 202

[56] References Cited

U.S. PATENT DOCUMENTS

| | | | |
|---|---|---|---|
| 2,118,609 | 3/1938 | Klug | 446/179 |
| 2,903,817 | 9/1959 | McLain et al. | 446/179 |
| 2,911,745 | 11/1959 | Simon | 446/179 |
| 3,083,497 | 4/1963 | Novak et al. | 446/179 |
| 3,559,330 | 2/1971 | Matlack | 446/179 |
| 3,887,182 | 6/1975 | Breslow | 273/450 |
| 4,423,565 | 1/1984 | Bart | 446/16 |
| 4,564,195 | 1/1986 | McClure et al. | 473/418 |
| 5,145,176 | 9/1992 | Lipson | 473/135 |
| 5,314,368 | 5/1994 | Cheng | 446/179 |
| 5,381,719 | 1/1995 | Otsuka | 84/600 |
| 5,613,890 | 3/1997 | DeMars | 446/15 |
| 5,664,947 | 9/1997 | Dietterich et al. | 434/84 |

*Primary Examiner*—Charles G. Freay
*Assistant Examiner*—Robert Z. Evora
*Attorney, Agent, or Firm*—Samuels, Gauthier & Stevens

[57] ABSTRACT

A levitation hand-holdable blower comprises a pistol like housing that has a butt 10 and a barrel 11. A motor 12 and a fan provide a flow of air along a channel and out of vents 17 to support a ball (not shown) in levitation manner. The blower is easily transportable and simple to operate.

6 Claims, 2 Drawing Sheets

LEVITATION BLOWER

BACKGROUND OF THE INVENTION

1. Field of the Invention

The invention relates to a levitation blower.

2. Description of Prior Art

It is known that objects can be suspended, apparently without support, in an upwardly directed stream of fluid, typically water or air. If the object is uniformly shaped, for example as a ball, and the stream channelled or focused, the object will inherently remain within the stream and appear to be suspended without support.

It has already been proposed to provide a simple levitation blower in the form of a pipe that fits to a mouth of a user, and also it is known to provide electric water pumps or air blowers supply from a mains supply and permanently mounted on a structure. These earlier proposals are respectively too simplistic or impractical as novelties or play items.

SUMMARY OF THE INVENTION

It is an object of the invention to overcome one or more of these advantages.

According to the invention there is provided a hand-holdable battery driven levitation blower for a ball comprising a housing in the general form of a pistol having a butt and a barrel, an electric motor and fan mounted inside the housing to blow air along a channel inside the barrel, a deflector formed at a remote end of the channel to direct the air upwardly out of the barrel, a battery compartment inside the butt, and an ON/OFF trigger switch for controlling the operation of the fan.

The housing is preferably formed of two pairs of molded plastic components, the first pair comprising mating halves of the butt and the second pair comprising mating halves of the barrel.

The fan may be a bladed radial fan mounted to rotate inside the barrel above the butt.

A circular shroud may be provided that surrounds a periphery of the fan.

A central axis of the shroud is preferably off-set from a central axis of the fan to form a peripheral convolute that increases in area in a direction of rotation of the fan.

The blower may include an I.C. chip and loudspeaker mounted inside the housing that is arranged to provide audio signals when the fan is turned ON.

BRIEF DESCRIPTION OF THE DRAWINGS

A levitation blower according to the invention will now be described by way of example with reference to the accompanying drawings in which.

DESCRIPTION OF THE PREFERRED EMBODIMENT

Figure 1:
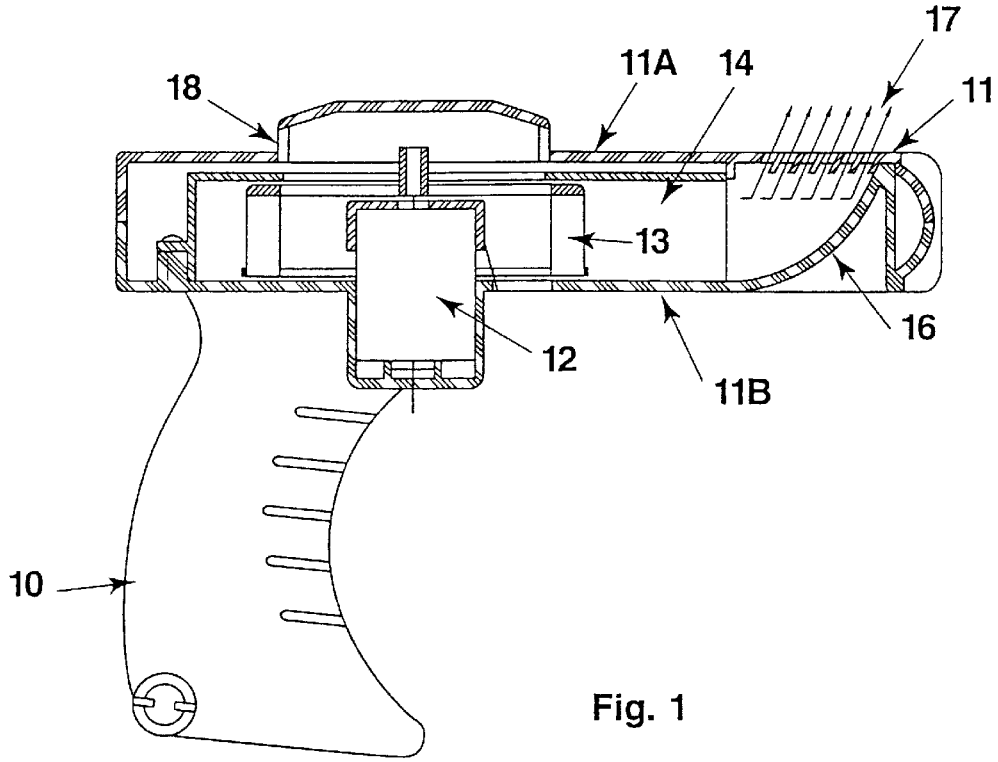
FIG. 1 is a sectional side view of the blower.

Referring to the drawings, the blower comprises a housing in the general form of a pistol having a butt 10 and handle 11. The butt is formed of plastic molded halves 1OA and 10B and the barrel is formed of two halves 11A and 11B. An electric motor 12 coupled to a radial fan 13 is mounted inside the housing to direct air along a channel 14 extending from a circular shroud 15 that fits over the fan 13. A deflector 16 is provided at a remote end of the channel 14 to direct air upwards out of the barrel 11. The deflector may be integrally formed with the barrel half 11B and deflect air out of outlet vents 17 formed in the barrel half 11A. Inlet vents 18 are formed in the barrel half 11A above the fan 13.

A trigger switch 19 is mounted adjacent a crotch of the pistol, for finger operation by the user, for controlling operation of the motor 12 as required. Battery terminals 20 are mounted inside the butt to fit to batteries (not shown) for supplying power to the motor 12. An IC melody chip and loudspeaker 21 is also mounted in the blower housing and controlled in use by the switch 19.

Figure 3:
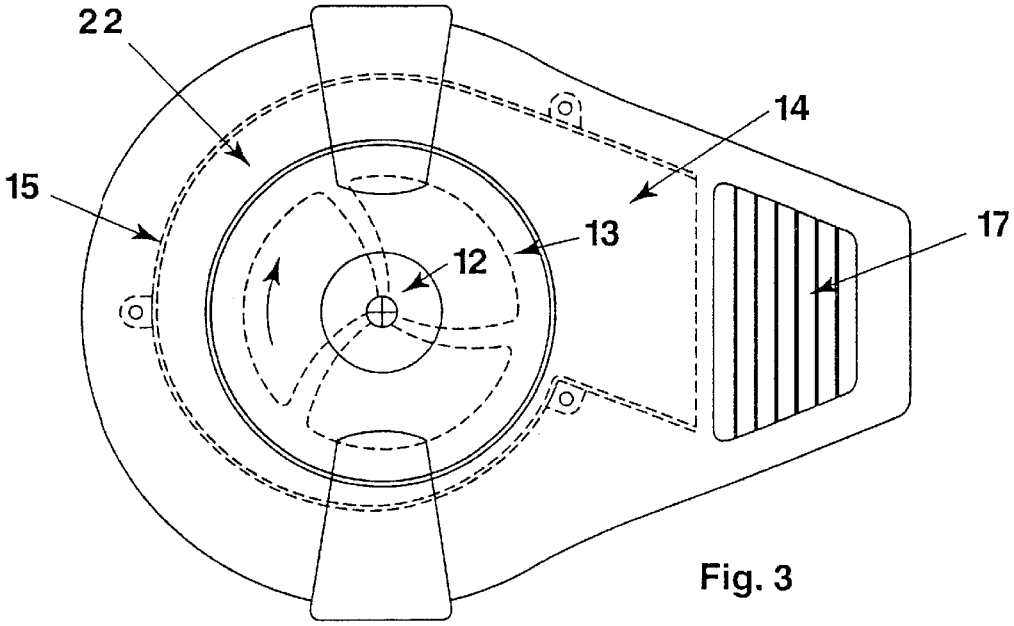
FIG. 3 is a top view of the blower.
Figure 2:
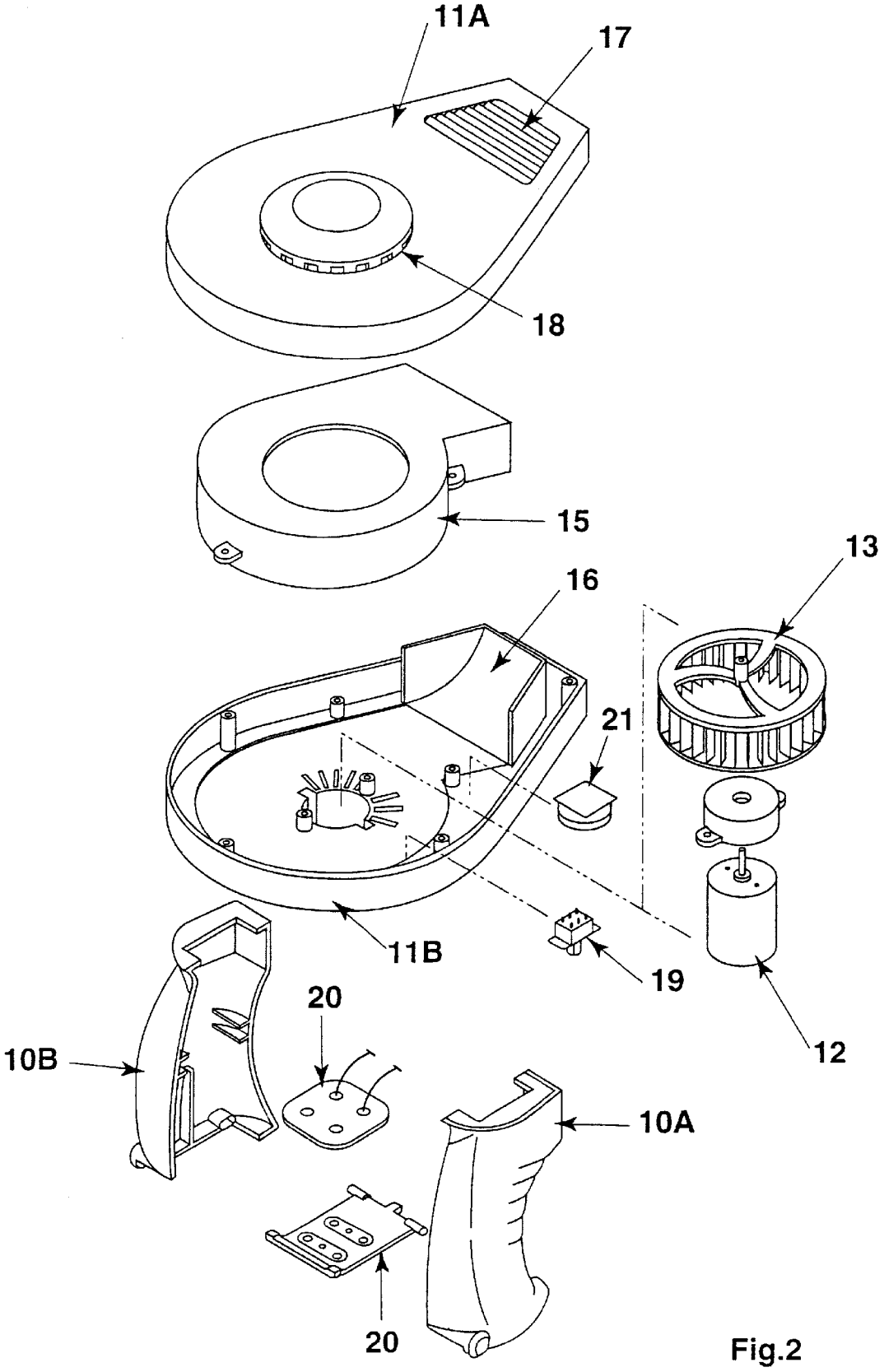
FIG. 2 is an isometric exploded view of the blower.

It will be noted in FIG. 3, that a central axis of the shroud 15 is off-set from a central rotation axis of the fan 13. This means that a peripheral convolute 22 formed around the fan 13 increases in area in a normal direction of rotation of the fan 13 (see arrow in FIG. 3). This allows air to be accelerated by the fan without creating much, if any, turbulence in the air flow.

In use, the user holds the blower as if it were a pistol, and switches ON the fan. Air is blown out off the vents 17 in a controlled vertical stream that will support a light ball in "levitation" above the barrel. The described hand-holdable blower allows the user to easily move around and manipulate the relative position of ball for substantial periods of time if required. This "play" can be accompanied by appropriate sounds or music generated by the I.C. chip.

I claim:

1. A hand-holdable battery driven levitation blower for a ball comprising a housing in the general form of a pistol having a butt and a barrel, an electric motor and fan mounted inside the housing to blow air along a channel inside the barrel, a deflector formed at a remote end of the channel to direct the air upwardly out of the barrel, a battery compartment inside the butt, and an ON/OFF trigger switch for controlling the operation of the fan.

2. A blower according to claim 1, in which the housing is formed of two pairs of molded plastic components, the first pair comprising mating halves of the butt and the second pair comprising mating halves of the barrel.

3. A blower according to claim 1, in which the fan is a bladed radial fan mounted to rotate inside the barrel above the butt.

4. A blower according to claim 3, including a circular shroud that surrounds a periphery of the fan.

5. A blower according to claim 3, in which a central axis of the shroud is off-set from a central axis of the fan to form a peripheral convolute that increases in area in a direction of rotation of the fan.

6. A blower according to claim 1, including an I.C. chip and loudspeaker mounted inside the housing that is arranged to provide audio signals when the fan is turned ON.

* * * * *